US006186356B1

(12) United States Patent
Berkley et al.

(10) Patent No.: US 6,186,356 B1
(45) Date of Patent: Feb. 13, 2001

(54) CLOSURE ASSEMBLY FOR LINED TANKS, AND VEHICLES EQUIPPED WITH THE SAME

(75) Inventors: George A. Berkley, Brigham City; Mark J. Warner, West Haven, both of UT (US)

(73) Assignee: Cordant Technologies Inc., Salt Lake City, UT (US)

( * ) Notice: Under 35 U.S.C. 154(b), the term of this patent shall be extended for 0 days.

(21) Appl. No.: 09/500,972

(22) Filed: Feb. 15, 2000

Related U.S. Application Data

(60) Provisional application No. 60/120,186, filed on Feb. 16, 1999, and provisional application No. 60/122,324, filed on Mar. 1, 1999.

(51) Int. Cl.[7] ..... B65D 25/16

(52) U.S. Cl. ..... 220/582; 220/586; 220/304; 220/502; 220/901

(58) Field of Search ..... 220/304, 586, 220/582, 502, 901

(56) References Cited

U.S. PATENT DOCUMENTS

| | | | | |
|---|---|---|---|---|
| 2,500,119 | | 3/1950 | Cooper | 220/27 |
| 3,840,139 | | 10/1974 | Harmon | 220/3 |
| 3,907,149 | | 9/1975 | Harmon | 200/3 |
| 3,917,115 | | 11/1975 | Travers et al. | 222/3 |
| 4,690,295 | | 9/1987 | Wills | 220/207 |
| 5,016,775 | * | 5/1991 | Büdenbender | 220/304 |
| 5,036,996 | * | 8/1991 | Epstein | 220/582 |
| 5,287,987 | | 2/1994 | Gaiser | 220/589 |
| 5,353,949 | * | 10/1994 | Seibert et al. | 220/304 |
| 5,379,913 | | 1/1995 | Rieke et al. | 220/601 |
| 5,429,845 | * | 7/1995 | Newhouse et al. | 220/582 |
| 5,494,188 | | 2/1996 | Sirosh | 220/590 |
| 5,577,630 | | 11/1996 | Blair et al. | 220/581 |
| 5,584,411 | | 12/1996 | Channell et al. | 220/465 |
| 5,746,344 | * | 5/1998 | Syler et al. | 220/582 |
| 5,819,978 | | 10/1998 | Hlebovy | 220/601 |
| 5,971,189 | * | 10/1999 | Baughman | 220/304 |

FOREIGN PATENT DOCUMENTS

| | | |
|---|---|---|
| 3901422C1 | 2/1990 | (DE) . |
| 0 409 255 A2 | 1/1991 | (EP) . |
| 2193953 | 2/1994 | (FR) . |

OTHER PUBLICATIONS

Superior Valve Company advertisement, Electronic Cylinder Shut–off Valve, Natural Gas Fuels Magazine, May, 1995.
Parker O–ring Handbook.

* cited by examiner

*Primary Examiner*—Joseph M. Moy
(74) *Attorney, Agent, or Firm*—Pillsbury Madison & Sutro LLP

(57) ABSTRACT

This pressurized-gas storage assembly includes a pressure vessel having a gas storage chamber and access opening, a polar boss extending through the access opening, a plastic liner lining the gas storage chamber, and a fitting body. The plastic liner includes a nipple portion that extends into the polar boss, terminates at an annular rim, and has a screw-threaded radially inner surface region. The fitting body includes a head portion, an extension longitudinally extending from an end of the head portion and having a screw-threaded radially outer surface region, and an annular shoulder. The annular shoulder has an annular recess formed therein, with a compressible O-ring being accommodated within the annular recess. By inserting the extension through the access opening and positioning the screw-threaded radially outer surface region of the extension into mechanical engagement with the screw-threaded radially inner surface region of the nipple portion, the O-ring is compressed between the annular shoulder of the fitting body and the annular rim of the liner. As a consequence, the O-ring is compressed and a hermetic seal is established between the inner liner and the fitting body, thereby preventing escape of stored compressed gas through the access opening.

20 Claims, 4 Drawing Sheets

CLOSURE ASSEMBLY FOR LINED TANKS, AND VEHICLES EQUIPPED WITH THE SAME

RELATED APPLICATIONS

Priority is claimed on U.S. provisional application Ser. No. 60/120,186 filed on Feb. 16, 1999 and U.S. provisional application Ser. No. 60/122,324 filed on Mar. 1, 1999, the complete disclosures of which are incorporated herein by reference to the extent that the disclosures are consistent and compatible with the following specification.

GOVERNMENT LICENCE RIGHTS

The U.S. Government has a paid-up license in this invention and the right in limited circumstances to require the patent owner to license others on reasonable terms as provided for by the terms of BNL 725014 awarded by Brookhaven National Laboratory.

BACKGROUND OF THE INVENTION

1. Field of the Invention

This invention relates to storage tanks having liners, especially storage tanks with plastic liners used for storing compressed gaseous fuels.

2. Description of the Related Art

Pressure vessels are widely used to store liquids and gases under pressure. One growing application of pressure vessels is their use in the storage of alternative fuels, such natural gas or propane, for use in vehicles such as automobiles. Natural gas and propane are increasingly viewed as preferable to gasoline for fueling vehicles. Accordingly, approaches have been devised for converting gasoline-fueled vehicles to natural gas-fueled or propane-fueled vehicles by retrofitting them to use natural gas or propane instead of gasoline. Additionally, new vehicles are currently being built which are designed to operate using natural gas or propane as the fuel source.

Vessels used for storing natural gases and propane preferably are equipped with a plastic liner, which serves to keep the stored gas from leaking. The plastic liner preferably covers the entire interior surface of the pressure vessel, including the neck portion, which defines an access opening for loading fuel. To prevent leakage of fuel at the access opening, an O-ring or other sealing means may be used.

An example of a sealing arrangement initially considered by the inventors is shown in FIG. 3. As shown in FIG. 3, the sealing arrangement includes a plastic liner 300 covering the inner surface 302 of a pressure vessel 304. A nipple portion 306 of the plastic liner 300 covers the inner periphery of the neck region 308 of a polar boss 310. An O-ring 312 abuts against the edge (unnumbered) of the neck region 308 and is urged towards the neck region 308 as fitting body 314 is moved towards the neck region 308 to compress the O-ring 312 therebetween. The fitting body 314 and the polar boss 310 have respective complementary screw-threaded surface regions facing and engaging each other at 316. Rotational movement of the fitting body 314 relative to the polar boss 310 mechanically engages the fitting body 314 to the pressure vessel 304 and seals the fitting body 314 against the nipple portion 306 of the plastic liner 300, with the O-ring 312 interposed therebetween to establish a hermetic seal.

While the design illustrated in FIG. 3 is acceptable under ideal operating conditions, under extreme temperature and pressure conditions, such as those sometimes encountered in harsh climates, the plastic liner 300 tends to contract, causing the liner 300 to move away from the fitting body 314. Separation of the edge of the plastic liner 300 from the polar boss 308 interrupts the hermetic seal created by the O-ring 312, causing fuel, especially in gaseous state, to leak from the pressure vessel 304 to the outside environment.

It would, therefore, be a significant advancement in the art to provide a simple sealing arrangement which, upon engagement of the fitting body to the storage vessel, forms a hermetic seal between the plastic liner and the end fitting that is resistant to high loading pressures and extreme operating temperatures, such as from about −40° C. 40° F.) to about 82.2° C. (180° F.).

SUMMARY OF THE INVENTION

It is, therefore, an object of this invention to address the problems outlined above and attain the above-mentioned advancement in the art by the provision of a pressurized-gas storage assembly with an improved closure assembly that prevents separation of the plastic liner from the polar boss of the pressure vessel.

In accordance with the principles of this invention, the above and other objects are accomplished by a pressurized-gas storage assembly including a pressure vessel, which comprises both an inner surface defining a gas storage chamber and a neck region defining an access opening in fluid communication with the gas storage chamber. A liner covers at least a portion, and preferably the entirety of the inner surface of the pressure vessel. A nipple portion of the liner extends into the neck region of the pressure vessel before terminating at an annular rim positioned within the neck region and facing away from the gas storage chamber. An annular O-ring is placed into the neck region of the pressure vessel to abut against the annular rim of the liner.

The assembly further includes an attachable fitting body for sealing and unsealing the access opening. The fitting body comprises a head portion terminating at one end at an annular shoulder, and an extension protruding from the head portion of the fitting body to define an inner circumference of the annular shoulder. When the fitting body is inserted into the neck region of the pressure vessel, the extension is received within and mechanically engaged with the nipple portion of the liner to prevent unintentional separation of the fitting body from the liner during use. As the fitting body is moved into mechanical engagement with the nipple portion of the liner, the annular shoulder of the fitting body simultaneously moves into close proximity to the annular rim of the liner, so that the O-ring resting on the annular rim is interposed between the annular shoulder and the annular rim and, depending upon the proximity of the annular rim to the annular shoulder, is compressed therebetween. The O-ring thereby establishes a hermetic seal between the liner and the fitting body, thus preventing escape of gas from the pressure vessel.

The inventive sealing assembly may be equipped in conventional tanks, including those having cylindrical configurations, as well as conformable tanks of the type described below. The assemblies may be installed in various types of vehicles, including, without limitation, automobiles, trucks, sports utility vehicles, military vehicles, and the like. In addition, the assemblies may be used for tanks, especially portable tanks, such as scuba tanks and oxygen tanks used by firefighters and the like.

Other objects, aspects and advantages of the invention will be apparent to those skilled in the art upon reading the specification and appended claims which, when read in conjunction with the accompanying drawings, explain the principles of this invention.

BRIEF DESCRIPTION OF THE DRAWINGS

The accompanying drawings facilitate an understanding of the principles of this invention. In such drawings.

DETAILED DESCRIPTION OF THE INVENTION

Figure 1:
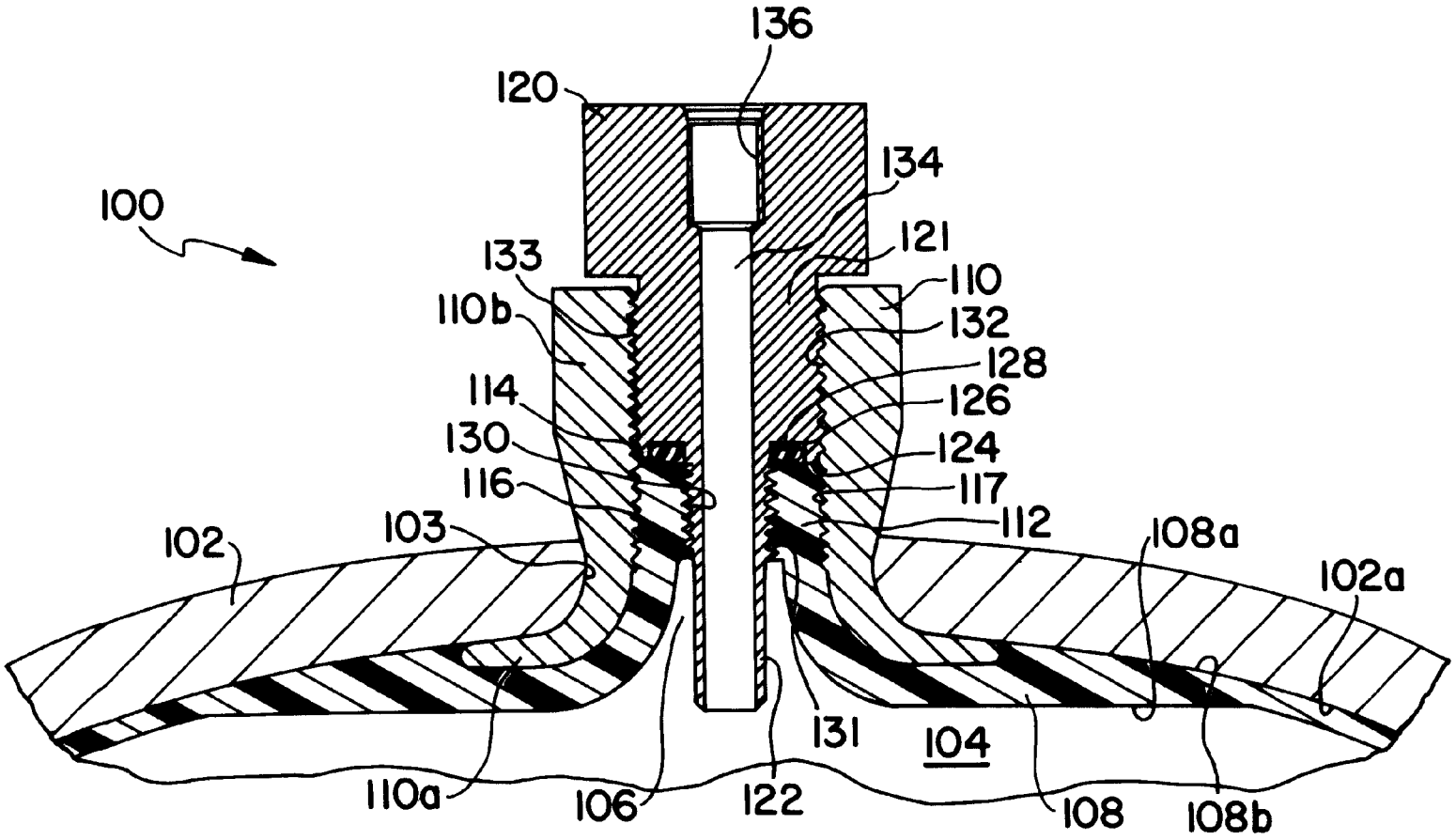
FIG. 1 is a schematic sectional view of a closure assembly according to an embodiment of this invention.

Referring now more particularly to the drawings, there is shown in FIG. 1 a pressurized-gas storage assembly, generally designated by reference numeral 100. An end portion of a pressure vessel 102 of the assembly 100 is shown in cut-away view. An aperture-defining edge 103 in the pressure vessel 102 defines an access opening 106 that permits fluid to be introduced into and removed from a gas storage chamber 104 of the pressure vessel 102.

A liner 108 is contiguous with and has a radially outer surface 108*b* contacting the inner surface 102*a* of the pressure vessel 102 in its entirety, except in the proximity of the access opening 106, where a radially extending part 110*a* of a polar boss 110 is interposed between an interfacing portion of the radially inner surface 102*a* of the pressure vessel 102 and the radially outer surface 108*b* of the liner 108. A longitudinally extending part 110*b* of the polar boss 110 extends through the access opening 106 and away from the gas storage chamber 104 to define a neck portion of the vessel 102. The longitudinally extending part 110*b* of the polar boss 110 includes a screw-threaded lower inner surface region 117 and, optionally, a screw-threaded upper radially inner surface region 132.

The radially inner surface 108*a* of the liner 108 defines the gas storage chamber 104. A nipple portion 112 of the plastic liner 108 contacting an inner surface (unnumbered) of the longitudinally extending part of the polar boss 110 protrudes into and through the access opening 106 and terminates at an annular rim 114, which faces away from the gas storage chamber 104. In the illustrated embodiment, the nipple portion 112 of the liner 108 has a screw-threaded radially outer surface region 116. The nipple portion 112 extends a sufficient distance into the polar boss 110 to allow the screw-threaded surface region 116 of the nipple portion to mechanically interlock with the complementary screw-threaded lower radially inner surface region 117 of the polar boss 110. However, the nipple portion 112 does not extend so far into the polar boss as to cover the screw-threaded upper radially inner surface region 132 of the polar boss 110.

The nipple portion 112 of the liner 108 also has a screw-threaded radially inner surface region 130, the purpose of which will be described in more detail below.

FIG. 1 shows fitting body 120 received in the access opening 106 for hermetically sealing the pressure vessel 102. The fitting body 120 includes head portion 121, and a tubular extension 122 protruding from the head portion 121. An annular shoulder 124 is defined at an end of the head portion 121, with the annular shoulder 124 having an inner circumference defined by the tubular extension 122. Formed within the annular shoulder 124 is an annular gland or recess 126, which is sized to accommodate a compressible O-ring 128. The tubular extension 122 of the fitting body 120 has a screw-threaded lower radially outer surface region 131. Optionally, the head portion 121 of the fitting body 120 has a screw-threaded upper radially outer surface region 133.

As shown in FIG. 1, when the fitting body 120 is received into the access opening 106, the tubular extension 122 extends through the access opening 106 to protrude towards the gas storage chamber 104, and the annular shoulder 124 faces towards the annular rim 114. Rotation of the fitting body 120 relative to the polar boss 110 in the appropriate tightening direction mechanically interlocks (a) the screw-threaded radially inner surface region 130 of the nipple portion 112 with the complementary screw-threaded lower radially outer surface region 131 of the tubular extension 122, and (b) the screw-threaded upper radially inner surface region 132 of the polar boss 110 with the complementary screw-threaded upper radially outer surface region 133 of the head portion 121 of the fitting body 120.

As rotation of the fitting body 120 relative to the polar boss 110 is continued, the mechanical interlock is tightened and the opposing annular rim 114 of the liner 108 and the annular recess 126 are brought into closer proximity. Preferably, the height of the annular gland 126 is slightly less than the thickness of the O-ring 128 (in an uncompressed state), so that the O-ring 128 is compressed (into a compressed state) between the shoulder 124 and the rim 114 as the fitting body 120 is moved further through the access opening 106 to a position at which the annular shoulder 124 abuts against the annular rim 114. In this manner, the O-ring 128 serves to provide a hermetic seal between the rim 114 of the liner 108 and the annular recess 138 of the fitting body 120.

The fitting body 120 has a central bore 134 formed therethrough for permitting, among other things, the filling and removal of gases from the pressure vessel 102. The central bore 134 includes a screw-threaded access port 136 constructed and arranged to permit engagement with a screw-threaded outer surface of a hose or tubing (not shown).

One of the advantages realized by the illustrated embodiment is that the hermetic seal provided by the O-ring 128 is not prone to fail at extreme temperatures or pressures. Rather, as the liner 108, especially a plastic liner, contracts in response to low temperatures or as the nipple portion 112 is urged away from the fitting body 120 by high internal pressures, the primary mechanical interlock provided by the screw-threaded surface regions 130 and 131 (and optionally, but preferably, the secondary mechanical interlock provided by screw-threaded surface regions 132 and 133) prevents the rim 114 of the liner 108 from separating from the shoulder 124 of the fitting body 120 by a sufficient distance to remove O-ring 128 from compression and break the hermetic seal. As a consequence, the O-ring 128 remains under compression and the seal remains intact.

Figure 2:
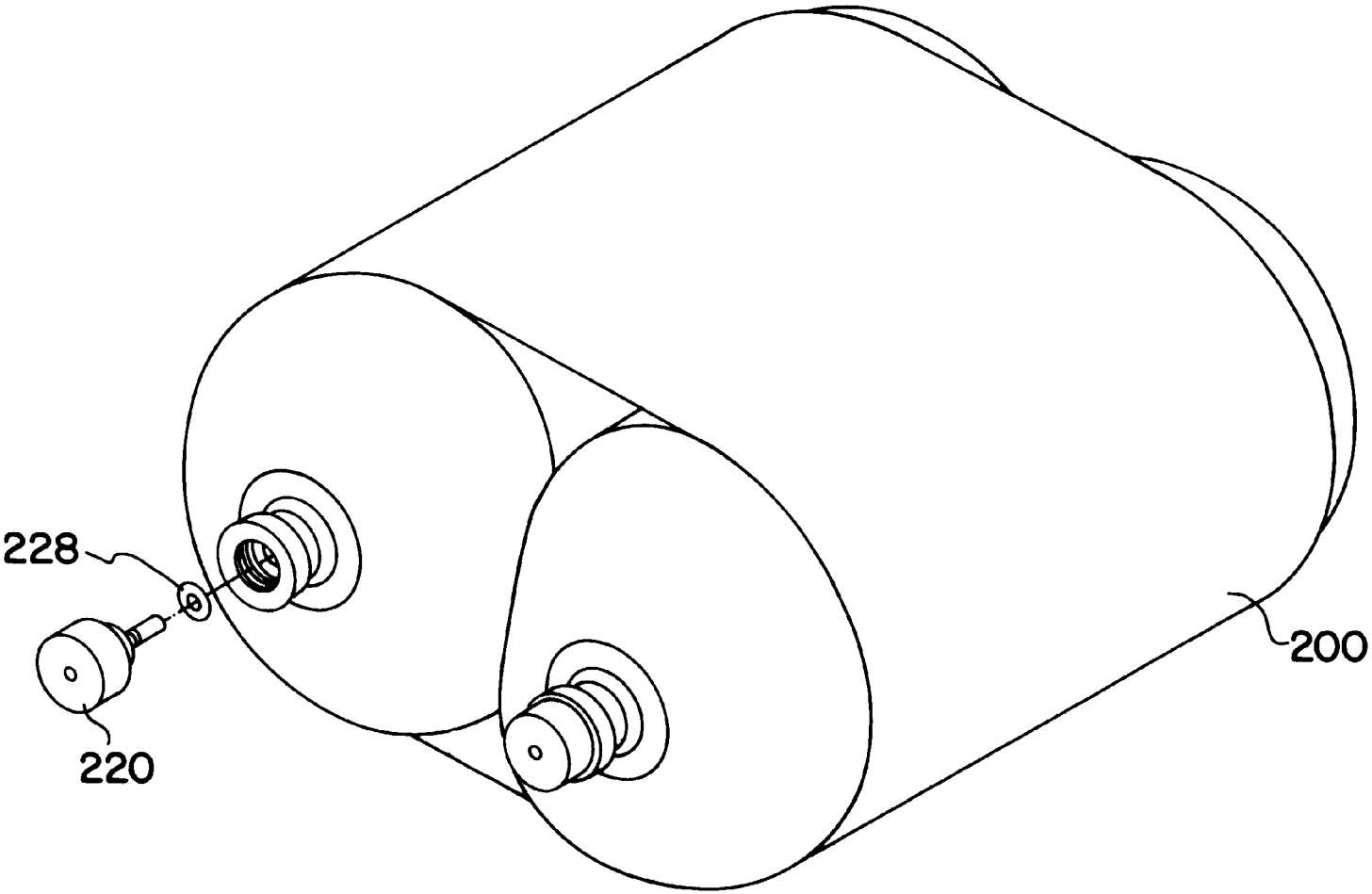
FIG. 2 is a perspective view of a conformable tank comprising a pair of closure assemblies, with one of the closure assemblies being shown in partially exploded view.
Figure 3:
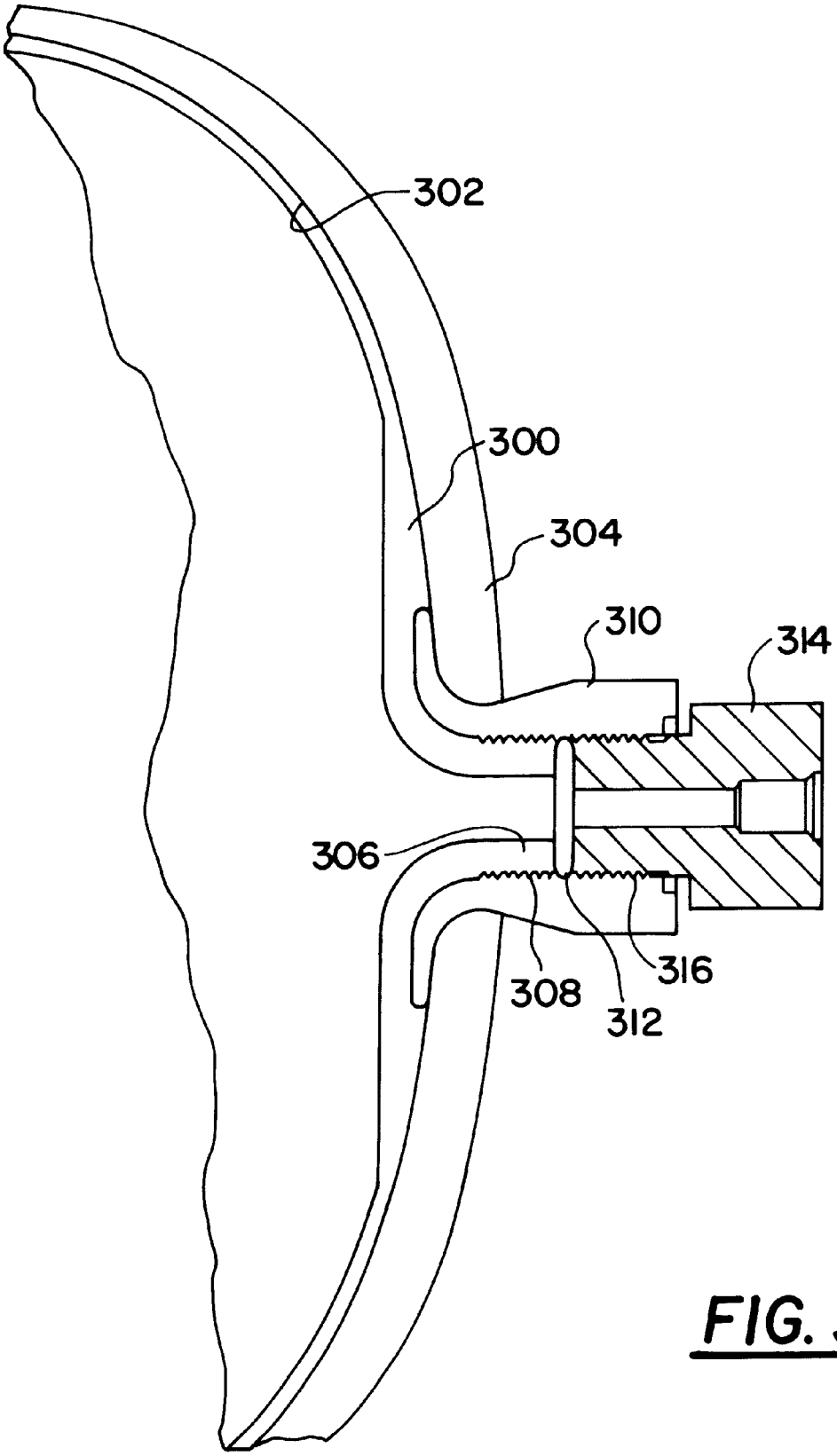
FIG. 3 is a schematic sectional view of an earlier embodiment of a closure assembly considered by the present inventors.

The sealing arrangement is especially suitable for plastic lined tanks, and in particular to conformable tanks of the type depicted in FIG. 2 and designated by reference numeral 200. Depicted in exploded view are an O-ring 228 and fitting body 220. Similar tanks, as well as other non-limiting examples of tanks with which the present invention may be used, are disclosed in U.S. Pat. No. 5,577,630 and PCT/US/15116 filed Sep. 3, 1997, the complete disclosures of which are incorporated herein by reference to the extent that they are consistent and compatible with this specification.

The pressure vessel is preferably made of a filament-wound composite material glass or carbon reinforced with TCR® prepreg supplied by Cordant Technologies, Inc.

The plastic liner may be formed from a thermoplastic or thermosetting material. Suitable materials for forming the plastic liner include, for example, polyamides, such as nylon 6, nylon 11, and nylon 12; polyethylene; polypropylene; polyurethane; and blends and copolymers thereof. The liner may also comprise a metal or metal alloy.

Representative materials for making the polar boss include, by way of example, metals, such as aluminum; alloys, such as steel; and/or plastics.

Representative materials for making the O-ring include, by way of example, nitrile-based compounds such as NBR; ethylene propylene copolymers; fluorocarbons; fluorosilicone; neoprene; and silicone.

Representative materials for making the fitting body include, by way of example, metals, such as aluminum; alloys, such as steel; and/or plastics.

Various modifications and variations to the illustrated embodiment fall within the scope of this invention and the appended claims.

For example, the polar boss may be formed integrally with the plastic liner and/or the pressure vessel. Additionally, various other mechanical engagement mechanisms may be used in addition to or as an alternative for the complementary screw threads to engage the fitting body to the inner liner. The illustrated access opening may be wider than that illustrated, and a plurality of such access openings and closure assemblies may be used.

Figure 5:
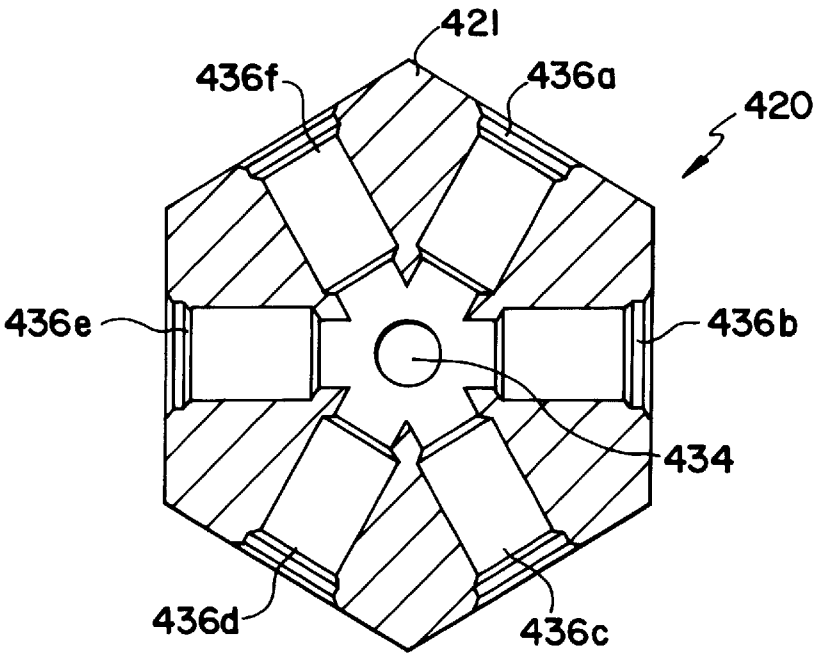
FIG. 5 is a sectional view of the multi-valve fitting body of FIG. 4, taken along line V—V of FIG. 4.
Figure 4:
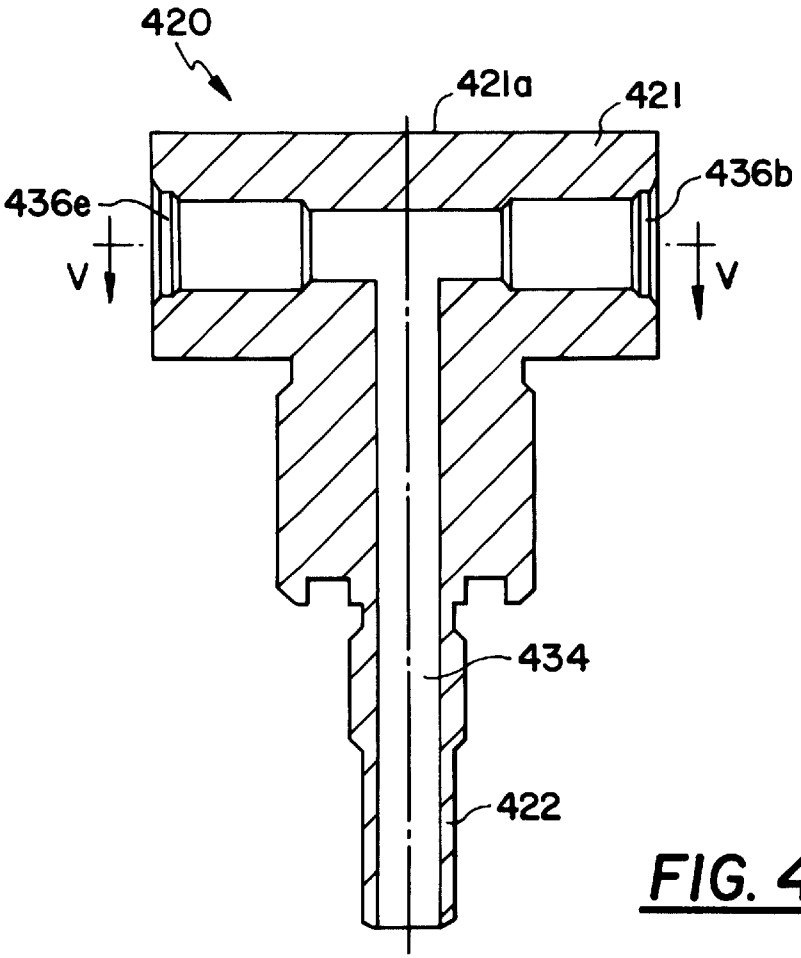
FIG. 4 is a side sectional view of a multi-valve fitting body of the closure assembly in accordance with another embodiment of this invention.

According to another modification illustrated in FIGS. 4 and 5, a multi-valve fitting body 420 can be used in the closure assembly. The multi-valve fitting body 420 illustrated in FIGS. 4 and 5 has a central bore 434 extending through the tubular extension 422 and terminating at its upper end in spaced relation to the upper surface 421 a of head portion 421 of the multi-valve fitting body 420. Formed in the head portion 421 of the fitting body 420 are a plurality (six in the illustrated embodiment) of screw-threaded access ports 436*a*, 436*b*, 436*c*, 436*d*, 436*e*, and 436*f*. These threaded access ports 436*a*–436*f* can individually be used for various respective functions, including attachment to pressure regulators, fill lines, vent lines, pressure monitoring devices, connecting lines between separate vessels, and the like. Ports not used are filled with plugs to prevent gas from within the storage vessel from escaping. Of course, additional or fewer than six threaded access ports may be included in the fitting body.

The multi-valve fitting body 420 allows the fitting to be installed to the correct torque level, and after installation, facilitates the lining-up of the ports with incoming and outgoing lines. In this manner, the overall length of the closure vessel can be reduced, placing the hardware around the end of the closure vessel.

The foregoing detailed description of the preferred embodiments of the invention has been provided for the purpose of explaining the principles of the invention and its practical application, thereby enabling others skilled in the art to understand the invention for various embodiments and with various modifications as are suited to the particular use contemplated. The foregoing detailed description is not intended to be exhaustive or to limit the invention to the precise embodiments disclosed. Modifications and equivalents will be apparent to practitioners skilled in this art and are encompassed within the spirit and scope of the appended claims.

We claim:

1. A pressurized-gas storage assembly comprising:

a pressure vessel having an inner surface and a gas storage chamber and comprising a neck region providing an access opening in fluid communication with said gas storage chamber;

a liner covering said inner surface and comprising a nipple portion extending into said neck region and terminating at an annular rim;

a fitting body comprising a head portion, an extension extending from an end of said head portion, and an annular shoulder provided at said end of said head portion and having an inner periphery defined by said extension, said annular shoulder having an annular recess formed therein, said extension being receivable in said nipple portion both to position said annular shoulder in opposing relationship with said annular rim and to permit mechanically engagement of said extension with said nipple portion; and an O-ring receivable in said annular recess and compressible between a non-compressed state, in which said O-ring has a sufficient thickness to extend beyond said annular recess, and a compressed state, wherein positioning of said extension into mechanical engagement with said nipple portion compresses said O-ring between said annular rim and said annular shoulder into the compressed state and establishes a hermetic seal between said inner liner and said fitting body.

2. A pressurized-gas storage assembly according to claim 1, wherein said liner comprises plastic.

3. A pressurized-gas storage assembly according to claim 2, wherein said plastic comprises at least one polyamide.

4. A pressurized-gas storage assembly according to claim 2, wherein said plastic comprises at least one member selected from the group consisting of polyethylene, polypropylene, polyurethane, and blends and copolymers thereof.

5. A pressurized-gas storage assembly according to claim 2, wherein said neck portion comprises a polar boss.

6. A pressurized-gas storage assembly according to claim 2, wherein said polar boss comprises a radial portion positioned in said gas storage chamber and a longitudinal portion extending through said access opening and away from said gas storage chamber.

7. A pressurized-gas storage assembly according to claim 2, wherein said pressure vessel comprises a composite material.

8. A pressurized-gas storage assembly according to claim 2, wherein mechanical engagement of said extension and nipple portion causes said annular rim to abut against said annular shoulder.

9. A pressurized-gas storage assembly according to claim 2, wherein said fitting body has a bore formed therethrough for permitting the filling and removal of gases from said pressure vessel.

10. A pressurized-gas storage assembly comprising:

a pressure vessel having an inner surface and a gas storage chamber and comprising a neck region providing an access opening in fluid communication with said gas storage chamber;

a liner covering said inner surface and comprising a nipple portion extending into said neck region and terminating at an annular rim, said nipple portion having a screw-threaded radially inner surface region a fitting body comprising a head portion, an extension extending from an end of said head portion and having a screw-threaded radially outer surface region that is complementary to and constructed and arranged to permit mechanical engagement with said screw-threaded radially inner surface region of said nipple portion, and an annular shoulder provided at said end of said head portion and having an inner periphery defined by said extension, said annular shoulder having an annular recess formed therein, said extension being receivable in said nipple portion both to position said annular shoulder in opposing relationship with said annular rim and to permit mechanically engagement of said screw-threaded radially outer surface region of said extension with said screw-threaded radially inner surface region of said nipple portion by relative rotation therebetween; and an O-ring receivable in said annular recess and compressible between a non-compressed state, in which said O-ring has a sufficient thickness to extend beyond said annular recess, and a compressed state, wherein positioning of said screw-threaded radially outer surface region of said extension into mechanical engagement with said screw-threaded radially inner surface region of said nipple portion compresses said O-ring between said annular rim and said annular shoulder into the compressed state and establishes a hermetic seal between said inner liner and said fitting body.

11. A pressurized-gas storage assembly according to claim 10, wherein said neck portion comprises a polar boss.

12. A pressurized-gas storage assembly according to claim 11, wherein said polar boss has a screw-threaded upper radially inner surface region, wherein said head portion of said fitting body has a screw-threaded radially outer surface region that is complementary to and mechanically engages with said screw-threaded upper radially inner surface region of said polar boss.

13. A pressurized-gas storage assembly according to claim 10, wherein said liner comprises plastic.

14. A pressurized-gas storage assembly according to claim 13, wherein said plastic comprises at least one polyamide.

15. A pressurized-gas storage assembly according to claim 13, wherein said plastic comprises at least one member selected from the group consisting of polyethylene, polypropylene, polyurethane, and blends and copolymers thereof.

16. A pressurized-gas storage assembly according to claim 10, wherein said pressure vessel comprises a composite material.

17. A pressurized-gas storage assembly according to claim 10, wherein mechanical engagement of said extension with said nipple portion causes said annular rim to abut against said annular shoulder.

18. A pressurized-gas storage assembly according to claim 10, wherein said fitting body has a bore formed therethrough for permitting the filling and removal of gases from said pressure vessel.

19. A vehicle comprising a pressurized-gas storage assembly, said pressurized-gas storage assembly comprising:

a pressure vessel having an inner surface and a gas storage chamber and comprising a neck region providing an access opening in fluid communication with said gas storage chamber;

a liner covering said inner surface and comprising a nipple portion extending into said neck region and terminating at an annular rim;

a fitting body comprising a head portion, an extension extending from an end of said head portion, and an annular shoulder provided at said end of said head portion and having an inner periphery defined by said extension, said annular shoulder having an annular recess formed therein, said extension being receivable in said nipple portion both to position said annular shoulder in opposing relationship with said annular rim and to permit mechanically engagement of said extension with said nipple portion; and an O-ring receivable in said annular recess and compressible between a non-compressed state, in which said O-ring has a sufficient thickness to extend beyond said annular recess, and a compressed state, wherein positioning of said extension into mechanical engagement with said nipple portion compresses said O-ring between said annular rim and said annular shoulder into the compressed state and establishes a hermetic seal between said inner liner and said fitting body.

20. A vehicle according to claim 19, wherein said nipple portion has a screw-threaded radially inner surface region, wherein said tubular extension has a screw-threaded radially outer surface region that is complementary to and constructed and arranged to permit mechanical engagement with said screw-threaded radially inner surface region of said nipple portion.

* * * * *